United States Patent [19]

Tryhorn

[11] Patent Number: 4,466,388

[45] Date of Patent: Aug. 21, 1984

[54] COMPRESSION IGNITION INTERNAL COMBUSTION ENGINE

[75] Inventor: Donald W. Tryhorn, Slough, England

[73] Assignee: Sir W. G. Armstrong Whitworth & Company, Ltd., Berkshire, England

[21] Appl. No.: 354,103

[22] Filed: Mar. 2, 1982

[30] Foreign Application Priority Data

Dec. 23, 1981 [GB] United Kingdom ..... 8138678

[51] Int. Cl.[3] ..... F01B 7/12

[52] U.S. Cl. ..... 123/51 BB; 123/54 B; 60/611; 74/604

[58] Field of Search ..... 123/54 R, 54 A, 54 B, 123/668, 669, 51 BB, 192 R, 192 B, 198 E; 60/611; 74/573 R, 603, 604, 589–591

[56] References Cited

U.S. PATENT DOCUMENTS

| | | | |
|---|---|---|---|
| 1,662,740 | 3/1928 | Dennison | 123/51 BB |
| 2,166,211 | 7/1939 | Gray | 123/51 BB |
| 2,381,465 | 8/1945 | Schroder | 123/51 BB |
| 2,730,087 | 1/1956 | Morton et al. | 123/51 BB |
| 3,369,733 | 2/1968 | Campbell | 123/54 B |
| 4,151,822 | 5/1979 | Miura et al. | 123/198 E |
| 4,227,372 | 10/1980 | Kakimoto et al. | 60/611 |
| 4,245,611 | 1/1981 | Mitchell et al. | 123/669 |
| 4,319,498 | 3/1982 | McWhorter | 74/604 |

FOREIGN PATENT DOCUMENTS

| | | | |
|---|---|---|---|
| 2030213 | 4/1980 | United Kingdom | 123/54 B |

*Primary Examiner*—Craig R. Feinberg

*Attorney, Agent, or Firm*—Remy J. VanOphem

[57] ABSTRACT

A compression ignition engine includes a pair of axially aligned pistons which are reciprocable in a common cylinder and each connected to a crankshaft by a linkage system which includes a rocker beam. Characteristically, it is proposed that a strut by which both the rocker beam fulcrums are separated is formed integrally with engine mounting brackets on which an engine main frame is supported through an interposed layer of resilient or flexible jointing material. Also proposed is a universal joint coupling between each piston rod and its associated rocker beam.

5 Claims, 1 Drawing Figure

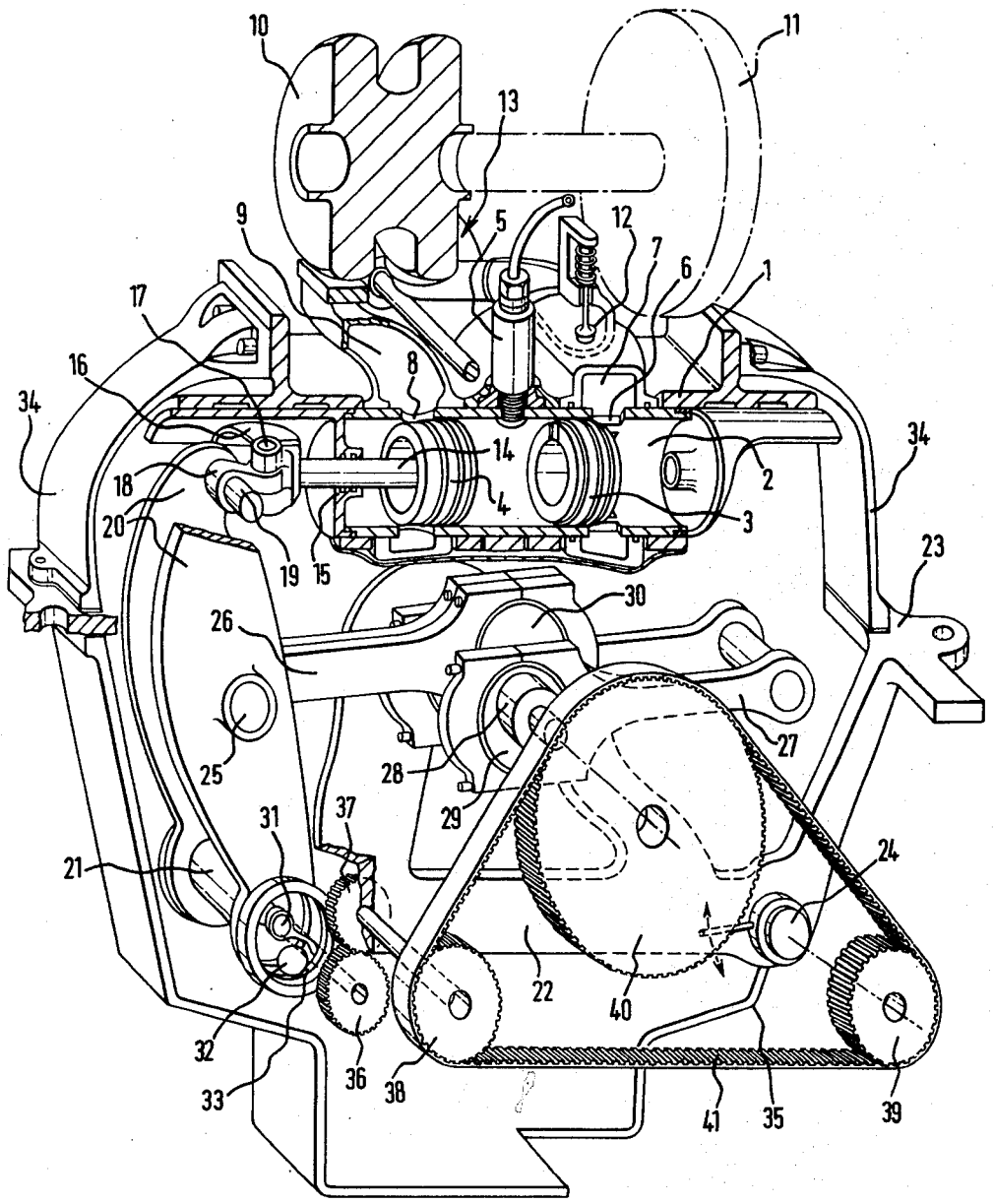
10
11
13
9
5
12
7
6
1
17
16
8
34
14
2
34
18
4
20
3
19
15
23
30
26
27
25
28
29
31
37
24
21
22
40
32
36
38
33
41
35
39

COMPRESSION IGNITION INTERNAL COMBUSTION ENGINE

BACKGROUND OF THE INVENTION

1. Field of the Invention

This invention relates to compression ignition internal combustion engines of the opposed piston type wherein each of a pair of axially aligned pistons is connected to a crankshaft by a linkage system including a rocker beam. An embodiment of this type of engine has been disclosed in the specification of our British Pat. No. 1472418.

2. Description of the Prior Art

In an opposed piston arrangement the fulcrums of the rocker beams react one on the other through the intermediary of a strut which maintains. It is known for this strut to be supported from the main frame of the engine which, at another position, supports the engine mounting brackets. In such a system the engine torque reaction forces, by passing through the frame, load this member and are a source of vibration and noise.

SUMMARY OF THE INVENTION

With a view to obviating this disadvantageous arrangement there is provided, in accordance with the present invention, a compression ignition engine of the type referred to which is characterized, in that a strut by which both the rocker beam fulcrums are separated is formed integrally with the engine mounting brackets on which the engine main frame is supported through an interposed layer of resilient or flexible jointing material.

In engines of this type, forces also develop along the beam due to changes in vertical velocity of the parts resulting from the swing action. These forces cause out of balance forces which load the mounts and cause vibration and noise. The invention also proposes the use of rotating balance masses in the rocker beam and fulcrum to counter these forces. It is best to have the center of gravity of the beam and associated masses directly above the fulcrum at the mid position of the piston stroke.

With the rocker beam eye bearing disposed in line with the center of gravity point and fulcrum bearing center, there is very little vertical movement of this bearing over the small arc required for the piston stroke, e.g. about cosine $\pm 8°$. To cope with this, a swinging link has heretofore been provided.

According to a further feature of the invention, the connection between the rod of each piston and its associated rocker beam is a universal joint. This arrangement accommodates manufacturing errors and permits a rectilinear piston rod motion to be obtained. It is within the scope of the invention to have intentional misalignment in order to improve the wipe of the bearings.

As a consequence of this rectilinear piston rod motion, it is a further feature of the invention to use a cylinder with closed ends and openings for piston rods passing through glands to isolate the cylinder from the crankcase.

Truly axial piston motion without piston side thrust removes from the piston the duty of being a thrust pad. Another feature of the invention is to use cylinders made of ceramic or other material suited to operation at high temperature, but unsuited to operation with high thrust and piston slap.

BRIEF DESCRIPTION OF THE DRAWINGS

An air cooled compression ignition engine in accordance with the invention is hereafter described by way of example with reference to the accompanying drawing which is a cut away view of the engine viewed in the general direction of the crankshaft axis. Certain duplicated engine components are not shown in the interests of clarity.

DETAILED DESCRIPTION OF THE PREFERRED EMBODIMENT

Referring now to the drawing there is shown the main frame 1 of the engine which is supported through the intermediary of upper covers 34 and resilient jointing material upon a pair of engine mounting brackets 23 which are bridged by an integral strut 22. Also supported from the mounting brackets 23 through the intermediary of resilient jointing material is a sump 35. In this manner the upper covers 34 and the sump 35 are isolated from the vibrations induced by torque fluctuations and the natural frequency of the running parts.

The main frame 1 holds a horizontal cylinder 2 which accommodates a pair of pistons 3, 4. Midway along the cylinder 2 is a fuel injector 5. Near one end of the cylinder is a ring of air inlet ports 6 which lead from an air manifold 7. The flow from the air manifold to the air inlet ports is controlled by the piston 3. Near the other end of the cylinder is a ring of exhaust gas ports 8 which lead to an exhaust manifold 9. The exhaust gas flow is also controlled by the piston 4. The exhaust manifold 9 leads to a turbocharger 10 with which there is associated an air inlet pipe with a filter 11. The turbocharger 10 delivers air to a scavenge pump 13 and also to a recirculation valve 12 connected to the air manifold 7. The recirculation valve 12 acts by bleeding off air from the air manifold 7 to the turbocharger delivery pipe to reduce the flow of fresh charge through the scavenge pump 13 when the pressure exceeds that of the delivery from the turbocharger by more than an amount determined by the recirculation valve loading spring. This system stops excessive rise of charging pressure with increasing engine speed. An arrangement of this kind is disclosed in British Patent Specification No. 1037347.

The driving linkage is similar on both sides of the engine and is shown on the exhaust side, the left hand side of the drawing of the engine. Thus the piston 4 has a piston rod 14 which passes through an oil sealing gland 15 to a universal coupling shown here as a Hooke's joint but with the pin axis displaced. The joint consists of a casing 16 which acts as a crosshead and contains bearings for a vertical pin 17 fixed to a link 18 and has a sufficient vertical clearance to cope with the vertical components of the arc of motion of a pin 19 which couples the link 18 to a pair of parallel identical rocker beams 20. The other end of each rocker beam 20 is supported by a fulcrum bearing 21 mounted upon the strut 22. The fulcrum bearing 21 contains an eccentric sleeve 24 which is capable of being rotated into a preset position to alter the separation of the fulcrum axes and thereby the separation of the pistons 3 and 4 and the compression ratio. Power is transmitted from a mid point along each rocker beam through a pin 25 coupled to the smaller end of a connecting rod 26 which consists of a pair of matched component rods mounted side by side so as to balance a connecting rod 27 consisting of two spaced component rods which transmits power in like manner from the rocker beams (not shown) which are coupled to the rod of the piston 3.

By reason of the existence of the vertical pin 17, the cylinder 2 could be inclined relative to the axis—which is exactly at right angles to the axes of the crankshaft 28, or the pin 25 need not stay exactly parallel to the crankshaft axis.

The connecting rods 26 and 27 are coupled to eccentrics 30 and 29 respectively on the crankshaft. The eccentrics are 180° out of phase so that the crank system with the pistons is in dynamic balance. The center of gravity of the rocking masses associated with the rocker beams 20 will undergo acceleration which may be divided into vertical and horizontal components. Due to the similarity of the rockers on each side of the crankshaft, and their opposite directions of movement, the horizontal accelerations will be equal and opposite and so the forces involved will balance at the crankshaft to impart no vibration of the engine. In the vertical direction the accelerations are in the same direction for both rocker beams and so the whole engine will move vertically by the reaction to the acceleration forces on the fulcrums. To oppose these forces it is proposed to create equal and opposite forces by means of rotating weights, to rotate in opposite directions so that their own horizontal forces will be in equal opposition and thereby cancel each other.

While the rocker beam moves to and fro, the vertical motion of its center of gravity is up and down and up and down. Thus, the frequency is double the engine running frequency. In order to balance these unbalancing forces without loading the bearings each rocker beam fulcrum bearing contains a shaft 31, only one of which is shown. The shafts 31 are driven at double the speed of the crankshaft in opposite directions respectively by a gear wheel 36 and a pulley wheel 39. The gear wheel 36 rotates in the opposite direction to a gear wheel 37 which is coupled to an external pulley 38. A toothed belt 41 drives both the pulleys 38 and 39 from a pulley 40 on the crankshaft at twice the crankshaft speed. Each shaft 31 has an arm which causes rotation of a ball 32 in a groove in a race 33 rigidly attached to the rocker beam. By rotating the shafts in opposite directions the horizontal components of the balance forces will oppose via the strut 22.

Preferably, the cylinder 2 or cylinder ature of the present engine compared with known engines used for automotive purposes. Elimination of water cooling is also an advantage for automotive engines.

As shown in the drawing, the engine has a single strut bearing 21 for each pair of half rocker beams but it is within the scope of the invention to have single rocker beams and a strut which is forked to accommodate two rocker beam fulcrum bearings at each end.

Mention has already been made of the reduction of noise and vibration which is a consequence of the integral construction of the rocker beam fulcrum strut and the engine mounting brackets.

The advantage of the universal coupling including the casing 16, the vertical pin 17, the link 18, and the pin 19 is that it permits rectilinear motion of the pistons without additional thrust loads on the coupling due to errors of alignment of the running gear. Alignment errors will cause bearing rotations within the universal joint and this improves the formation of oil films. In particular the small vertical motion benefits from a small degree of rotation.

I claim:

1. A compression ignition engine comprising:

a main engine frame;

engine mounting brackets disposed adjacent said main engine frame;

a layer of resilient jointing material interposed said main engine frame and said engine mounting brackets such that said main engine frame is supported by said engine mounting brackets through said layer of resilient jointing material;

a cylinder mounted to said main engine frame;

a pair of axially aligned pistons reciprocally mounted in said cylinder;

a strut member being integral with and interposed said engine mounting brackets;

a crankshaft mounted to said strut member;

connecting means for connecting each of said pair of axially aligned pistons to said crankshaft, said connecting means further comprising at least one rocker beam having respectively one end coupled to one of said pair of axially aligned pistons, an opposite end coupled to said strut member, and a central portion between said one end and said opposite end communicating with said crankshaft, said opposite end of each of said at least one rocker beam further acting as a fulcrum point having an axis such that a predetermined portion of the balancing force is translated to said strut member, said opposite end of each of said at least one rocker beam having a mass constrained to revolve around said axis of said fulcrum point so as to counteract an unbalancing force directed along said at least one rocker beam; and a shaft having a central axis coaxially disposed with said axis of said fulcrum point; an arm mounted to said shaft for rotation therewith; an annular race coaxially disposed with said shaft; and gear train means attached at one end to said shaft and at another opposite end communicating with said crankshaft whereby said mass is revolvable in said annular race by impulsion of said arm which is rotatable by said gear train means and said crankshaft.

2. A compression ignition engine in accordance with claim 1 further comprising a pair of piston rods, one of said pair of piston rods being attached to one of said pair of axially aligned pistons, the other of said pair of piston rods being attached respectively to the other of said pair of axially aligned pistons, said cylinder further being closed at each end except for sealed openings through which each of said pair of piston rods extend respectively.

3. A compression ignition engine in accordance with claim 1 further comprising a turbocharger with a recirculating air valve in the outlet thereof.

4. A compression ignition engine in accordance with claim 1 wherein each one of said pair of axially aligned pistons is coupled respectively to one and another one of said at least one rocker beam by means of a universal joint.

5. A compression ignition engine in accordance with claim 4 in which said pair of axially aligned pistons and said cylinder are made of ceramic material.

* * * * *

UNITED STATES PATENT AND TRADEMARK OFFICE

CERTIFICATE OF CORRECTION

PATENT NO. : 4,466,388

DATED : August 21, 1984

INVENTOR(S) : Donald Wilfred Tryhorn

It is certified that error appears in the above-identified patent and that said Letters Patent is hereby corrected as shown below:

Column 1, line 18, after "maintains" insert ---- separation ----.

Column 3, line 47, delete "ature of the" and insert ---- liner and the pistons 3 and 4 are made of ceramic material such as Zirconium to withstand the high combustion temperatures and cause minimum heat loss before the exhaust gas reaches the turbocharger 10. The provision of universal couplings or Hooke's joints relieves the pistons of side loads and of the requirement for a thick oil film on the pistons. The pistons are isolated from the engine oil and so the parts forming the combustion chamber can run hotter than if an oil film had to be retained. The elimination of sump oil from the exhaust gas is an important feature of the ----.

Signed and Sealed this

*Twenty-sixth* Day of *March 1985*

[SEAL]

*Attest:*

DONALD J. QUIGG

*Attesting Officer* *Acting Commissioner of Patents and Trademarks*

UNITED STATES PATENT AND TRADEMARK OFFICE

CERTIFICATE OF CORRECTION

PATENT NO. : 4,466,388

DATED : August 21, 1984

INVENTOR(S) : Donald W. Tryhorn

It is certified that error appears in the above-identified patent and that said Letters Patent is hereby corrected as shown below:

Title page, Assignee: delete "Sir W. G. Armstrong Whitworth & Company, Ltd.," and insert ---- Sir W. G. Armstrong Whitworth & Company (Engineers) Limited ----.

Signed and Sealed this

*Third* Day of *December 1985*

[SEAL]

*Attest:*

DONALD J. QUIGG

*Attesting Officer*

*Commissioner of Patents and Trademarks*